US009117378B2

(12) United States Patent
Sipperley et al.

(10) Patent No.: US 9,117,378 B2
(45) **Date of Patent: *Aug. 25, 2015**

(54) PORTABLE ADVERTISING PLATFORM

(71) Applicant: Freight Train Media LLC, Cleveland, OH (US)

(72) Inventors: Raymond P. Sipperley, Lattingtown, NY (US); Donald E. MacCord, Jr., Fall City, WA (US)

(73) Assignee: Freight Train Media LLC, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/058,557

(22) Filed: Oct. 21, 2013

(65) Prior Publication Data

US 2014/0047743 A1 Feb. 20, 2014

Related U.S. Application Data

(63) Continuation of application No. 12/842,110, filed on Jul. 23, 2010, now Pat. No. 8,595,965.

(51) Int. Cl.

| | |
|---|---|
| ***G09F 15/00*** | (2006.01) |
| ***G09F 13/02*** | (2006.01) |
| ***B61D 3/16*** | (2006.01) |
| ***G09F 21/04*** | (2006.01) |
| ***B61D 15/00*** | (2006.01) |

(52) U.S. Cl.

CPC *G09F 13/02* (2013.01); *B61D 3/16* (2013.01); *B61D 15/00* (2013.01); *G09F 15/0037* (2013.01); *G09F 15/0087* (2013.01); *G09F 21/04* (2013.01)

(58) Field of Classification Search

USPC ..... 40/588, 589, 590, 601, 612, 624; 105/439, 457, 461; 248/127, 146, 512, 248/539; 256/18, 2, 8

See application file for complete search history.

(56) References Cited

U.S. PATENT DOCUMENTS

| | | | |
|---|---|---|---|
| 263,698 | A | 9/1882 | Halkyard |
| 375,186 | A | 12/1887 | Neamann |
| 3,842,524 | A | 10/1974 | Drueck, Jr. |
| 3,852,902 | A | 12/1974 | Wheeler |
| 4,077,144 | A | 3/1978 | Smits |
| 4,110,792 | A | 8/1978 | Long et al. |
| 4,186,665 | A | 2/1980 | de Jong et al. |
| 4,782,615 | A | 11/1988 | Futatsuishi et al. |
| 5,083,826 | A | 1/1992 | McCrary |
| 6,053,281 | A | 4/2000 | Murray |
| 6,750,829 | B2 | 6/2004 | Luoma et al. |

(Continued)

*Primary Examiner* — Joanne Silbermann
*Assistant Examiner* — Christopher e Veraa
(74) *Attorney, Agent, or Firm* — Sand & Sebolt

(57) ABSTRACT

An advertising system and method of use includes a rail car and an advertising billboard mounted thereon. Preferably, the billboard is adjustable so that advertising thereon can be positioned to face desired viewers, such as people traveling on roadways adjacent a railroad track. The billboard may rotate and/or be raised and lowered by a lift, which may include a telescoping post. An onboard electric power source is typically provided to power lights and other electric components. Outriggers may be used to help stabilize the rail car when parked especially for windy conditions. A security fence may be mounted on the rail car to protect various components thereon. The billboard may include one section which can be raised relative to another section for display purposes and lowered to provide a lower height during transport. The rail car may carry an additional billboard.

20 Claims, 7 Drawing Sheets

(56) References Cited

U.S. PATENT DOCUMENTS

| | | | | |
|---|---|---|---|---|
| 7,575,225 | B1 | 8/2009 | Saldana | |
| 2004/0016158 | A1 | 1/2004 | Kim | |
| 2004/0172870 | A1* | 9/2004 | Buring et al. | 40/590 |
| 2007/0103266 | A1 | 5/2007 | Wang et al. | |
| 2007/0272644 | A1* | 11/2007 | McDonald | 212/245 |
| 2008/0278934 | A1* | 11/2008 | Maldonado | 362/183 |
| 2010/0043264 | A1 | 2/2010 | Johnson, Jr. | |

* cited by examiner

PORTABLE ADVERTISING PLATFORM

CROSS REFERENCE TO RELATED APPLICATION

This application is a continuation of U.S. patent application Ser. No. 12/842,110, filed Jul. 23, 2010; the disclosure of which is incorporated herein by reference.

BACKGROUND OF THE INVENTION

1. Technical Field

The present invention relates generally to portable advertising billboards. More particularly, the present invention relates to a railway vehicle which is configured to travel along a railroad track and carry a billboard to an advertising location typically adjacent a roadway traveled by automobiles and the like. Specifically, the invention relates to such a vehicle and a method of using the same wherein the billboard is in a traveling position during travel along the railroad track and in a display position when the vehicle is at the advertising location.

2. Background Information

Stationary advertising billboards are well known, and are utilized along various types of roadways. Various types of portable advertising have also been used on railway cars and trolley cars in order to display advertising as the cars are traveling. The railroad tracks which crisscross the United States and various other countries are quite extensive. However, not all of these tracks are actively used. In addition, some of the tracks are used only infrequently. However, many of these tracks intersect, cross over, cross under or run adjacent roadways which are reasonably heavily traveled by cars and trucks. Thus, these unused or under-used tracks present locations which are highly suited to advertisement to people traveling in cars and trucks along these roadways. The present invention provides a railway vehicle and method of taking advantage of these locations for the purposes of advertising.

BRIEF SUMMARY OF THE INVENTION

In one aspect, the invention may provide an advertising system for use on a railroad track, the system comprising: a railcar having a deck area and track-engaging wheels adapted to roll on the railroad track; an advertising billboard mounted on the railcar above the deck area; a security fence which extends around the deck area to deter trespassers; and at least one locking mechanism securing the fence to the railcar so that the fence cannot be removed from the railcar without the use of a key configured to unlock the at least one locking mechanism.

In another aspect, the invention may provide an advertising system for use on a railroad track, the system comprising: a railcar having a deck area and track-engaging wheels adapted to roll on the railroad track; an advertising billboard mounted on the railcar above the deck area; a security fence which extends around the deck area to deter trespassers and comprises a plurality of fence posts removably mounted on the railcar; and a plurality of locking mechanisms which respectively secure the posts to the railcar so that the fence posts cannot be removed from the railcar without the use of a key configured to unlock the respective locking mechanism.

In another aspect, the invention may provide a method comprising the steps of: displaying advertising on a billboard above a deck area of a railcar on a railroad track; deterring trespassers from gaining access to the deck area with a security fence which extends around the deck area; and unlocking at least one locking mechanism with a key to allow at least a portion of the fence to be detached from the railcar.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
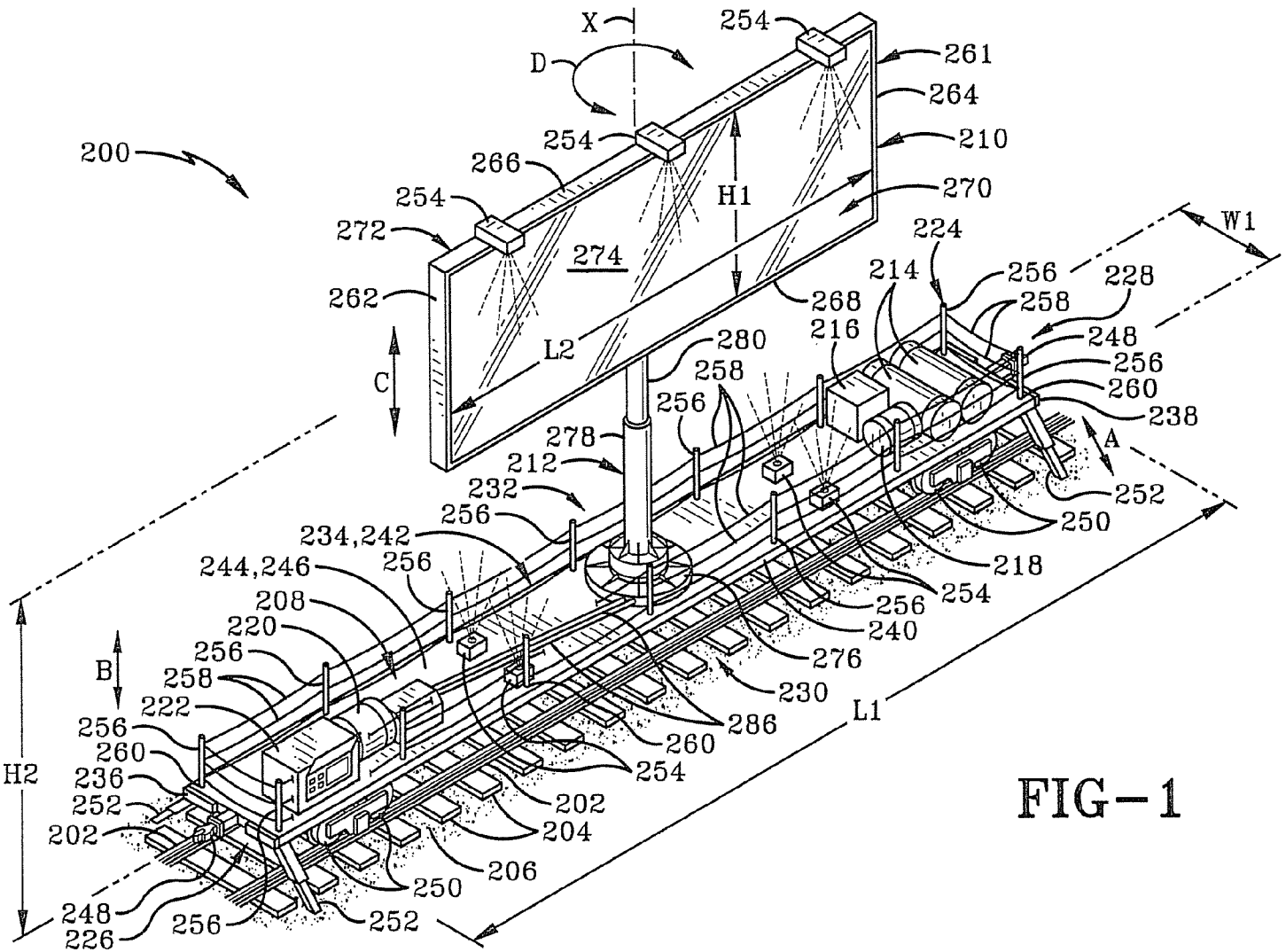
FIG. 1 is a perspective view of the first embodiment of the portable advertising system of the present invention with the billboard in the raised position.

The advertising vehicle of the present invention is shown generally at 200 in FIG. 1. Vehicle 200 is configured for travel along a railway which includes a railroad track comprising a pair of parallel rails 202 secured to railroad ties 204 which are embedded in a railroad bed 206 of the railway. Vehicle 200 includes a flatbed railcar 208 and a billboard 210 which is mounted on railcar 208 by a vertical support post 212. An onboard independent power generation source includes one or more fuel tanks 214, a fuel powered engine or motor 216 which is powered by fuel within tanks 214, and an electric generator 218 which is driven by motor 216 to produce electrical power. The fuel within tanks 214 is typically diesel fuel or gasoline. In addition, the power generation source may include solar panels configured to produce electric power. Alternately or in combination, a plug-in device may be utilized in order to take advantage of any off-board electrical power source which may be adjacent the advertising location at which vehicle 200 may be ultimately utilized. A drive mechanism 220 such as a hydraulic pump assembly is mounted on railcar 208 and operatively connected to billboard 210 and post 212 to drive movement of these components. Drive mechanism 220 is in electrical communication with generator 218 or other electric power source. A protective cover 211 (FIG. 3) may also be used to help protect the display section of billboard 210 during travel along the railroad track. A control unit 222 is also carried by railcar 208 for purposes described further below. Vehicle 200 may also include a security fence 224 which extends entirely around the outer perimeter of the flatbed deck of car 208 and thus also around the various components 210-222 in order to protect against or provide a deterrent to graffiti and trespassing on the deck area of the railcar to deter trespassers from tampering with and/or damaging the various components of the vehicle 200 within fence 224.

Vehicle 200 has first and second ends 226 and 228 defining therebetween a longitudinal direction of the vehicle which is generally parallel to the direction of travel along the railroad track and thus parallel to rails 202. Vehicle 200 also has first and second sides 230 and 232 defining therebetween an axial direction of vehicle 200 which is generally perpendicular to the direction of travel and rails 202. Railcar 208 includes a flatbed 234 having first and second ends 236 and 238 defining therebetween a length L1 which is typically in the range of about 53 to 89 feet. Flatbed 234 has first and second sides 240 and 242 defining therebetween a width W1 which is typically on the order of about 9 feet. Length L1 and width W1 are within any applicable governmental or industry standards required. Flatbed 234 is a substantially flat and horizontal rigid structure which is rectangular as viewed from above. Flatbed 234 includes a rigid frame typically formed of metal and a flat rectangular deck 244 having a horizontal upwardly facing top surface 246 which is exposed to the outdoor or ambient atmosphere or air, and thus outdoor weather conditions. Thus, railcar 208 typically is free of a roof extending over the flatbed and is likewise free of solid walls extending upwardly from the flatbed with which a roof would define a fully enclosed cargo hold or passenger compartment.

Couplers 248 are respectively secured to the flatbed adjacent ends 236 and 238 and extend outwardly therefrom. Each coupler 248 is in the form of a universal attachment system for securing the railcar to another railcar, typically a powered railcar configured to push or tow vehicle 200 along the railroad track. Four sets of track-engaging or rail-engaging wheels 250 are mounted on flatbed 234 via suitable suspension assemblies. In particular, two of these sets are adjacent first end 236 and respectively engage the pair of rails 202, and the other two sets are respectively adjacent second end 238 and respectively engage the pair of rails 202. Vehicle 200 is thus configured to roll along the rails 202 of the railroad track on wheels 250. Typically, vehicle 200 is not a self-driving vehicle and thus typically does not include an engine or transmission for driving wheels 250, which are thus non-driving wheels. Stabilizers or outriggers 252 are mounted on flatbed 234 and are moveable between raised and lowered positions so that vehicle 200 is suited for travel along the railroad track when outriggers 252 are raised, and vehicle 200 is in a stationary position or parked when outriggers 252 are lowered to engage railroad bed 206 to provide additional stability to the vehicle, as may be needed for windy conditions. Outriggers 252 are thus out of contact with the ground or any portion of the railway in the raised position. Arrow A illustrates the movement of each outrigger 252 between its raised and lowered positions. Drive mechanism 220 may be operatively connected to outriggers 252 to drive their movement between raised and lowered positions. However, an alternate drive mechanism may be used for this purpose, including an electric motor drive mechanism or a hand operated drive mechanism which may, for example, use a threaded engagement between an upper and lower section of the outrigger. Outriggers 252 are shown adjacent both sides 240 and 242 of the railcar as well as adjacent the first and second ends 236 and 238 thereof. Preferably, at least a pair of outriggers 252 are carried by the car respectively adjacent sides 240 and 242.

Depending on the specific type of billboard used on vehicle 200, lights 254 may be mounted on railcar 208 and/or on billboard 210 such that when illuminated, the light emitted therefrom shines onto the advertisement portion of the billboard. When such lights are used, they are powered by generator 218, or the other power sources described earlier. In addition, such lights are typically in electrical or other communication with control unit 222, which may include a timer or light sensor for sensing the ambient light in order to control when lights 254 are turned on and off.

Security fence 224 includes a plurality of fence posts 256 which are secured to extend upwardly from flat bed 234 along its outer perimeter. Thus, there are typically fence posts 256 adjacent the corners formed at the intersection of end 236 and sides 240 and 242, as well as adjacent the corners formed at the intersection of end 238 and sides 240 and 242. In addition, there are typically several longitudinally spaced vertical fence posts 256 along each side 240 and 242. Additional posts may be used between the corner posts along ends 236 or 238. Barbed wire 258 is strung between the adjacent fence posts 256 such that the barbed wire extends all the way around the outer perimeter of deck 244 upwardly of flatbed 234 (best shown in FIG. 1 although portions of wire 258 are shown cut away for clarity). Fence 224 may include other components, such as boards or planks extending between posts 256. Typically, however, barbed wire 258 or other similar structures such as concertina wire or razor wire will be positioned adjacent at least the top of the fence to provide a substantial deterrent to potential trespassers from gaining access to the deck area of the railcar. Typically, fence 224 is detachable from the railcar so that it may be deployed when vehicle 200 is at its advertising location and detached as needed in order to more easily access the flatbed and various components thereon for servicing said components. To ensure the integrity of fence 224 when it is deployed, locking mechanisms 260 may be used to secure respective posts 256 adjacent their lower ends to flatbed 234 so that fence posts 256 cannot be removed from the railcar without the use of a key configured to unlock the respective locking mechanism. Arrow B illustrates the mounting or attachment as well as the dismounting or detachment of fence posts 256, along with wire 258, from the railcar.

Billboard 210 is a large flat rectangular structure which is substantially vertical. Billboard 210 has first and second vertical edges 262 and 264 defining therebetween a longitudinal direction of the billboard. Billboard 210 has a horizontal top or top edge 266 and a horizontal bottom or bottom edge 268 which extend respectively from first edge 262 to second edge 264. Billboard 210 also has a first or display side 270 and a second opposed side 272 which may be a non-display side or may be configured as a display side such that the display sides are configured to display advertising thereon. Each of sides 270 and 272 are flat and substantially vertical and rectangular as viewed when facing the respective side. Billboard 210 includes a rigid billboard frame 261 which is typically made primarily of metal. An advertising display section 274 is mounted on display side 270 of frame 261 and is configured for displaying advertising thereon. Display section 274 is typically the same size as or nearly the same size as first display side 270. First and second ends or edges 262 and 264 define therebetween a horizontal length L2 which may vary substantially. The industry standard for the length of stationary billboards which are permanently anchored to the ground is about 48 feet, and length L2 may be on this order. Top and bottom edges 266 and 268 define therebetween a vertical height H1 which again may vary although the industry standard for stationary billboards is about 14 feet, and height H1 may be on this order. Frame 261 and display section 274 thus have respective heights and lengths which are approximately represented by height H1 and length L2. Display section 274 may be any suitable display section which allows for advertising to be displayed thereon. Thus, a flexible sheet of material may serve as the advertising display section 274 where various advertising words and/or images are depicted thereon in any suitable fashion. Such a sheet of material may be formed of vinyl or other suitable materials. When vinyl or the like is used, lighting assemblies 254 are also typically used and positioned in order to focus their light during illumination onto display section 274 when lighting is needed or desired. Display section 274 may also be formed of multiple LEDs (Light Emitting Diodes) or may use a digital display, a plasma screen, or any other suitable display section. Billboard 210 in its entirety is vertically moveable in a linear fashion (Arrow C) upwardly and downwardly between a raised and a lowered position. In addition, billboard 210 in its entirety is rotatable about vertical axis X, which is the central axis of post 212.

Figure 3:
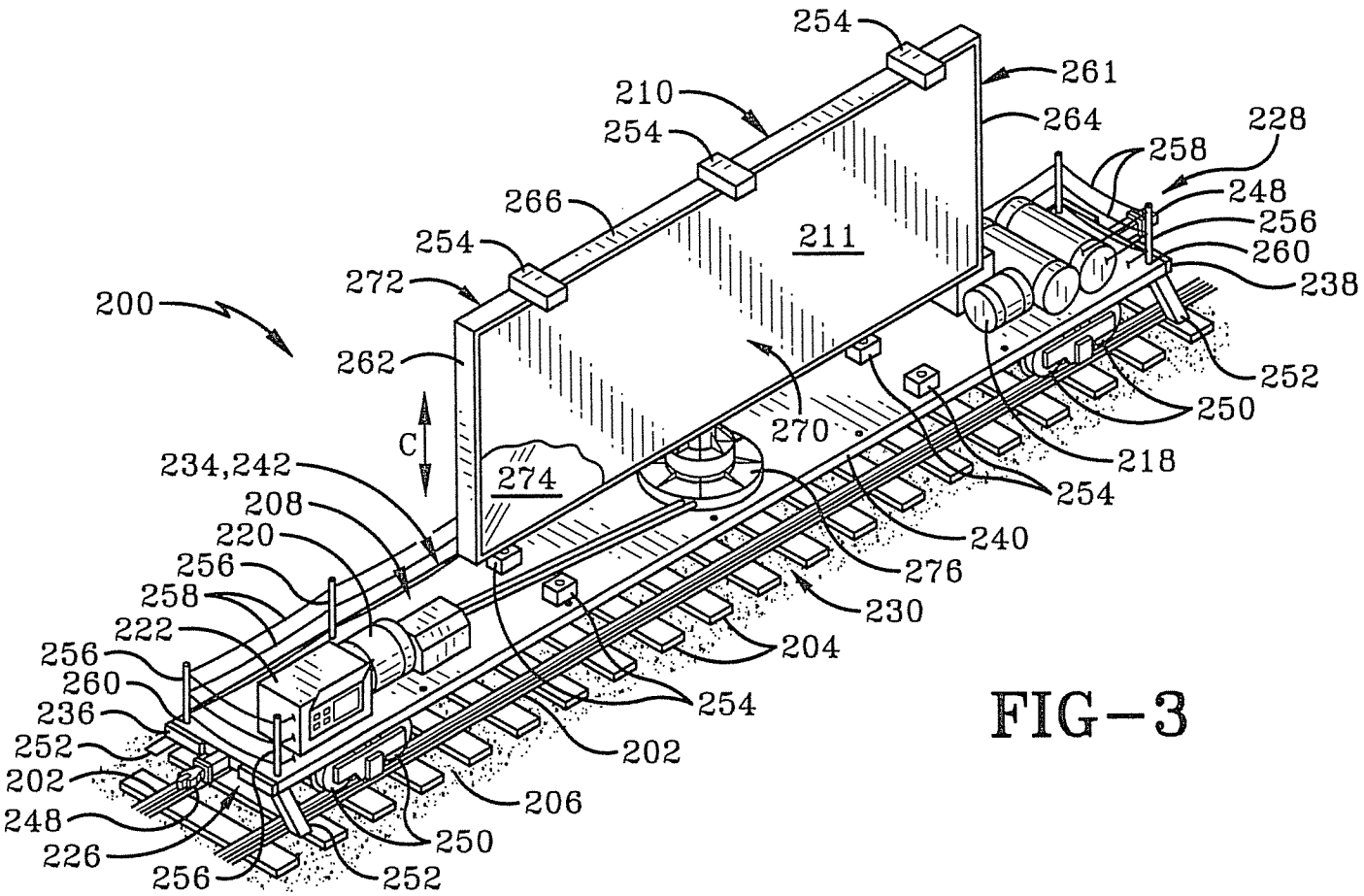
FIG. 3 is similar to FIGS. 1 and 2 and shows the billboard in the lowered traveling position with the protective cover mounted thereon.

As previously noted, protective cover 211 may be used to cover display section 274 during the transport of the railcar along the railroad track. FIG. 3 illustrates cover 211 in a covered position in which it entirely covers display section 274. Thus, cover 211 is approximately the same height H1 and length L2 of billboard 210, and has top and bottom horizontal edges which are at approximately the same height as top and bottom edges 266 and 268 and extend along the entire length thereof, as well as vertical opposed edges which are respectively adjacent side edges 262 and 264 and extend along the entire height thereof. Cover 211 may be formed of any suitable material, such as one or more sheets of plywood, a combination of boards which are laid adjacent one another, one or more sheets of aluminum or the like. Cover 211 is most commonly used when display section 274 includes LEDs, a digital display, plasma screen, or the like where the protection of such display sections is desirable. Cover 211 is secured to frame 261 of the billboard along its outer perimeter by any fasteners suitable for this purpose. In the exemplary embodiment, cover 211 is entirely removable from the frame of billboard 210 and thus is moveable between the covered position of FIG. 3 and the uncovered or exposing position of FIG. 1 in which cover 211 does not cover display section 274, which is thus fully exposed.

Support post 212 is a telescoping pole and is part of a lift for raising and lowering billboard 210. In addition, post 212 is rotatable about vertical axis X whereby billboard 210 rotates therewith. A relatively large rigid base 276 is rigidly secured to the top surface 246 of deck 244 about midway between first and second ends 236 and 238 and extends from adjacent first side 240 to adjacent second side 242. Post 212 and axis X are substantially equidistant from ends 236 and 238. In the exemplary embodiment, base 276 includes a substantially flat large metal disk which is oriented horizontally. The telescoping pole 212 includes a lower section or hollow pole 278, a middle section or pole 280 and an upper section or pole 282 such that middle pole 280 is telescopically received within the hollow pole 278, and upper pole 282 is telescopically received within middle pole 280 and lower pole 278. A rigid circular annular flange 284 is rigidly secured to and extends radially outwardly from the bottom of lower pole 278. Annular flange 284 is rotatably mounted atop base 276 to rotate relative thereto about vertical axis X. Flange 284 is directly above base 276 and rotatably mounted thereon typically by suitable ball bearings or other rollable bearings which roll on base 276 and on which flange 284 rolls during its rotation. Rigid mounting flanges 285 are rigidly secured to the upper pole 282 and extend horizontally outwardly therefrom. Flanges 285 are also rigidly secured to second side 272 of billboard frame 261 in order to fully support billboard 210 in the raised and lowered positions. In the exemplary embodiment, post assembly 212 provides the sole structural support which supports billboard 210 and extends downwardly from the bottom of billboard 210 to the deck or frame work of the flat bed 234.

Figure 2:
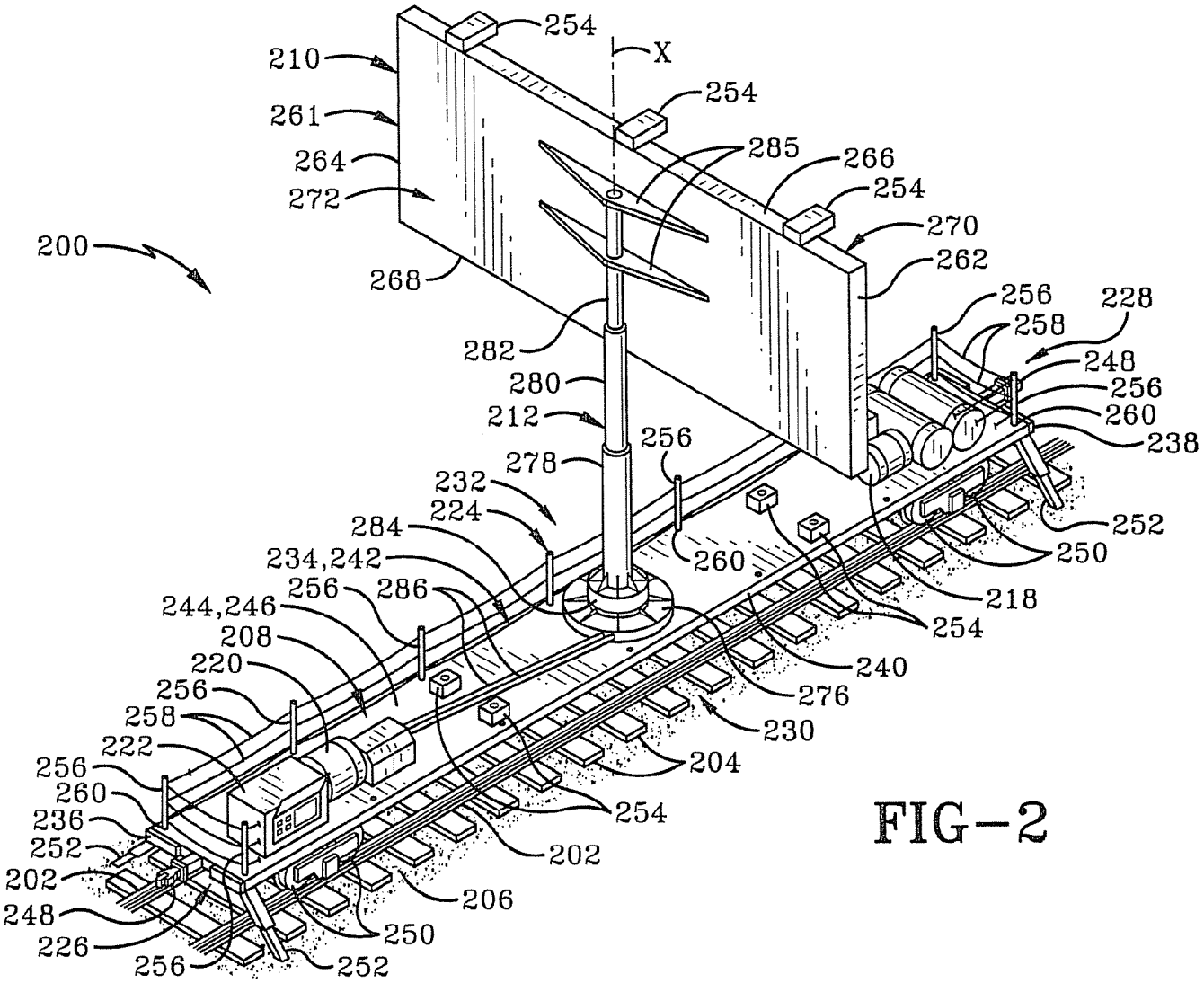
FIG. 2 is a perspective view similar to FIG. 1 with the billboard in a raised position and rotated 90° relative to the position of FIG. 1.

Drive mechanism 220 is operatively connected to telescoping pole 212 in order to raise and lower poles 280 and 282 relative to pole 278 in a telescoping fashion, whereby the drive mechanism likewise raises and lowers billboard 210 with upper pole 282. As previously noted, drive mechanism 220 may include a hydraulic pump assembly. In that case, hydraulic lines 286 are provided which connect the hydraulic pump assembly to the lift or pole 212 in order to drive the upward movement (Arrow C) of the pole and billboard 210 relative to the railcar. Drive mechanism 220 is also configured to drive the rotation of the telescoping pole and billboard relative to base 276 and the railcar. Pole 212 and billboard 210 are thus rotatable about vertical axis X (Arrow D) between a position (FIGS. 1, 3) which is substantially parallel to sides 240 and 242 of the railcar to a position (FIG. 2) which is substantially perpendicular thereto. The pole and billboard may be rotated 90° in either direction from the parallel position in order to provide the desired orientation of advertising display section 274.

FIG. 3 illustrates billboard 210 in its transport or traveling position, such that billboard 210 is in its lowered position as well as oriented substantially parallel to sides 240 and 242 of the railcar. This orientation minimizes wind resistance which occurs during travel of vehicle 200 along the railway inasmuch as one of the relatively narrow or thin edges 262 and 264 serves as the leading edge during this travel instead of the rather large surface area presented by one of sides 270 or 272. Billboard 210 is also typically in its lowered position during travel, which also minimizes wind resistance as well as ensures that large billboards stay within the maximum height limitation H2 designated by the Association of American Railroads or other governmental institutions or industry standards. Height H2 is typically on the order of about 18 feet and measured from around the top of one of rails 202. Thus, the top 266 of billboard 210 is no higher than the maximum height H2 in the lowered position although it is typically higher than the maximum height H2 when in its raised position when vehicle 200 is stationary.

Figure 4:
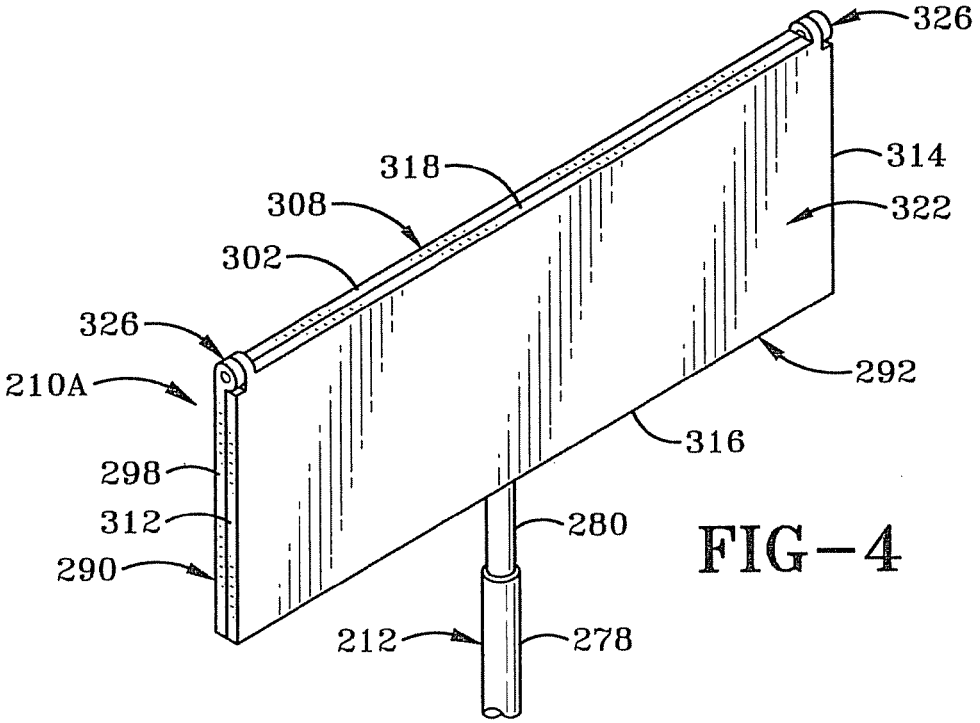
FIG. 4 is a perspective view of a second embodiment of the billboard with the raise-able section of the billboard in its lowered position.
Figure 5:
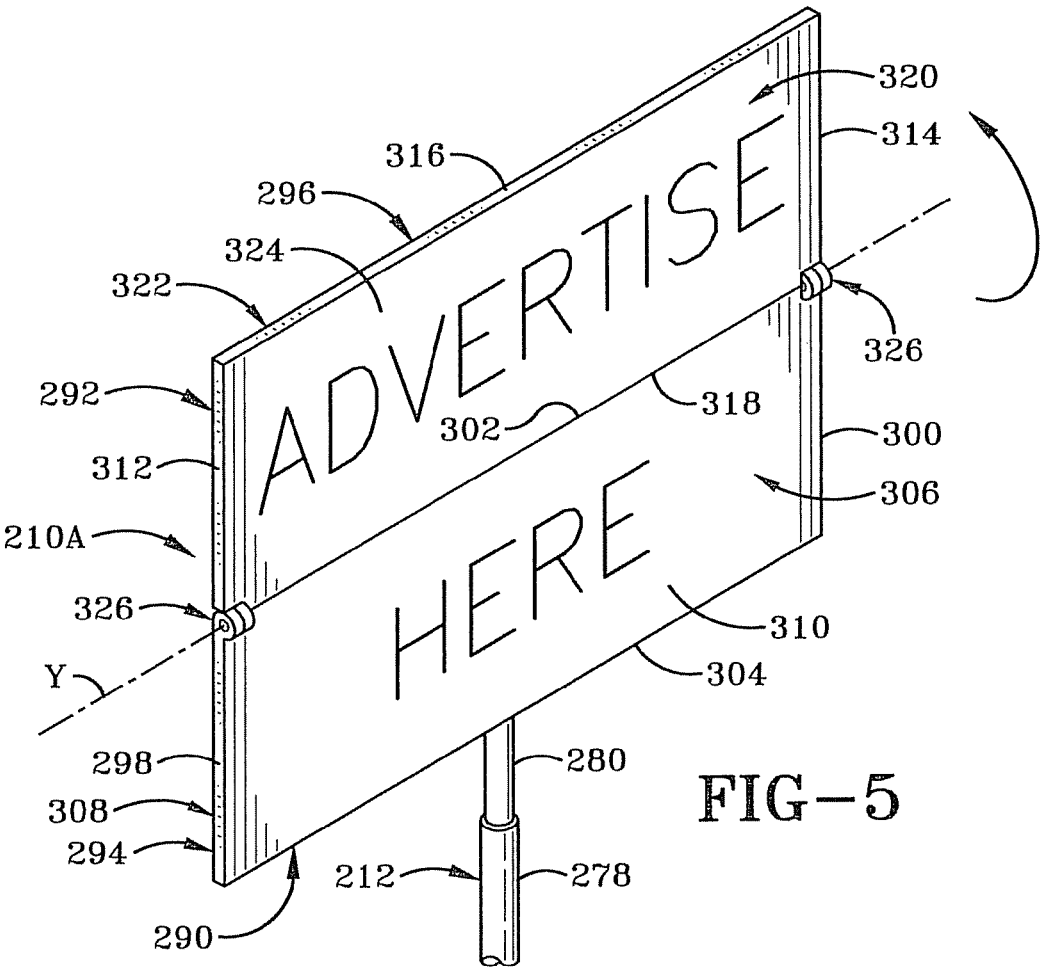
FIG. 5 shows the raise-able section of the billboard in its raised position.

FIGS. 4 and 5 illustrate an alternate embodiment of a billboard 210A which is mounted in a similar manner on upper pole or segment 280 of post assembly 212 so that billboard 210A may be raised, lowered, and rotated in the same manner as billboard 210. However, billboard 210A includes a first section 290 and a second section 292 which is moveable relative to first section 290 between a collapsed or lowered position (FIG. 4) and an expanded or raised position (FIG. 5). As previously noted, there are standards which require that the structures of a railcar or the structures carried by a railcar not exceed height H2 (FIG. 1). However, some billboards may be too large to meet this requirement even in the lowered position of the lift, such as shown in FIG. 3. Thus, billboard 210A allows the billboard to be within the height limitations during travel while exceeding them when the railcar is parked for the purpose of advertising. Thus, the rigid frame of billboard 210A is formed primarily of a first rigid frame or frame section 294 of first section 290 and a second rigid frame or frame section 296 of second section 292. Each of sections 290 and 292, as well as frames or frame sections 294 and 296 are relatively large rectangular flat structures which in both the collapsed and raised positions are parallel to one another and vertical. In the collapsed position, first and second sections 290 and 292 and their respective frames are generally side-by-side at about the same height whereas section 292 in the raised or expanded position is directly above and extends upwardly from section 290 so that sections 290 and 292 are substantially coplanar. First section 290 and frame 294 have first and second vertical side edges 298 and 300, horizontal top and bottom edges 302 and 304, flat vertical first and second rectangular sides 306 and 308 wherein first side 306 is a display side, and an advertising display section 310 mounted on frame 294 on display side 306. Advertising display section 310 is substantially the same size as frame 294 and is thus flat, vertical, and substantially rectangular. Second section 292 and second frame 296 are similar to section 290 and frame 294, and thus have vertical first and second opposed edges 312 and 314, horizontal top and bottom edges 316 and 318 (in the raised position of FIG. 5), first and second flat rectangular display sides 320 and 322 which are vertical in the raised and collapsed positions, and an advertising display section 324 on display side 320. In the exemplary embodiment, the frames of the first and second sections 290 and 292 are pivotally connected by hinges 326 and are pivotable about a horizontal axis Y passing through the hinges. Hinges 326 may include a securing mechanism to secure section 292 in the raised position and in the collapsed position if needed. However, other securing mechanisms may be used which are not within the hinges.

In the collapsed position of FIG. 4, top edge 316 of second section 292 serves as the bottom edge while bottom edge 318 serves as the top edge of section 292. In the collapsed position, edges 302 and 318 are substantially coplanar and face upwardly while edges 316 and 304 are likewise substantially coplanar and face downwardly. Thus, edge 316 is adjacent and extends along edge 304 in the collapsed position and is spaced downwardly from edge 302. Edges 298 and 312 in the collapsed position are adjacent one another along their entire length, or height, as are edges 300 and 314. Display side 320 and display section 324 face and are closely adjacent display side 306 and display section 310 such that the display sides and display sections are superimposed on one another in the collapsed position. In the collapsed position, second sides 308 and 322 are vertical, parallel and face away from one another.

The arrow in FIG. 5 illustrates that section 292 has been flipped up via hinges 326 about axis Y to the expanded or raised position of section 292 so that display sides 306 and 320 are substantially coplanar and face in the same direction. In addition, display section 310 and display section 324 are likewise substantially coplanar and face the same direction whereby the display sections may be combined into a single display section with advertising displayed on both display sections as illustrated in FIG. 5. In the expanded position, edge 316 faces upwardly and is spaced upwardly from top edge 302 of section 290. In addition, edge 318 faces downwardly such that edge 318 faces edge 302 with edges 318 and 302 closely adjacent or abutting one another. Edge 312 is vertically aligned with and directly above edge 298 so that together they form a substantially vertical edge along billboard 210A in the expanded position. Similarly, edge 314 is substantially vertically aligned, coplanar with and directly above edge 300 so that together they form a vertical edge extending from the top to the bottom of billboard 210A. In the expanded position, edge 316 thus defines the top of the billboard and edge 304 defines the bottom of the billboard. In the expanded position, second side 308 and second side 322 are substantially coplanar and face in the same direction away from the respective display sections and display sides.

Figure 6:
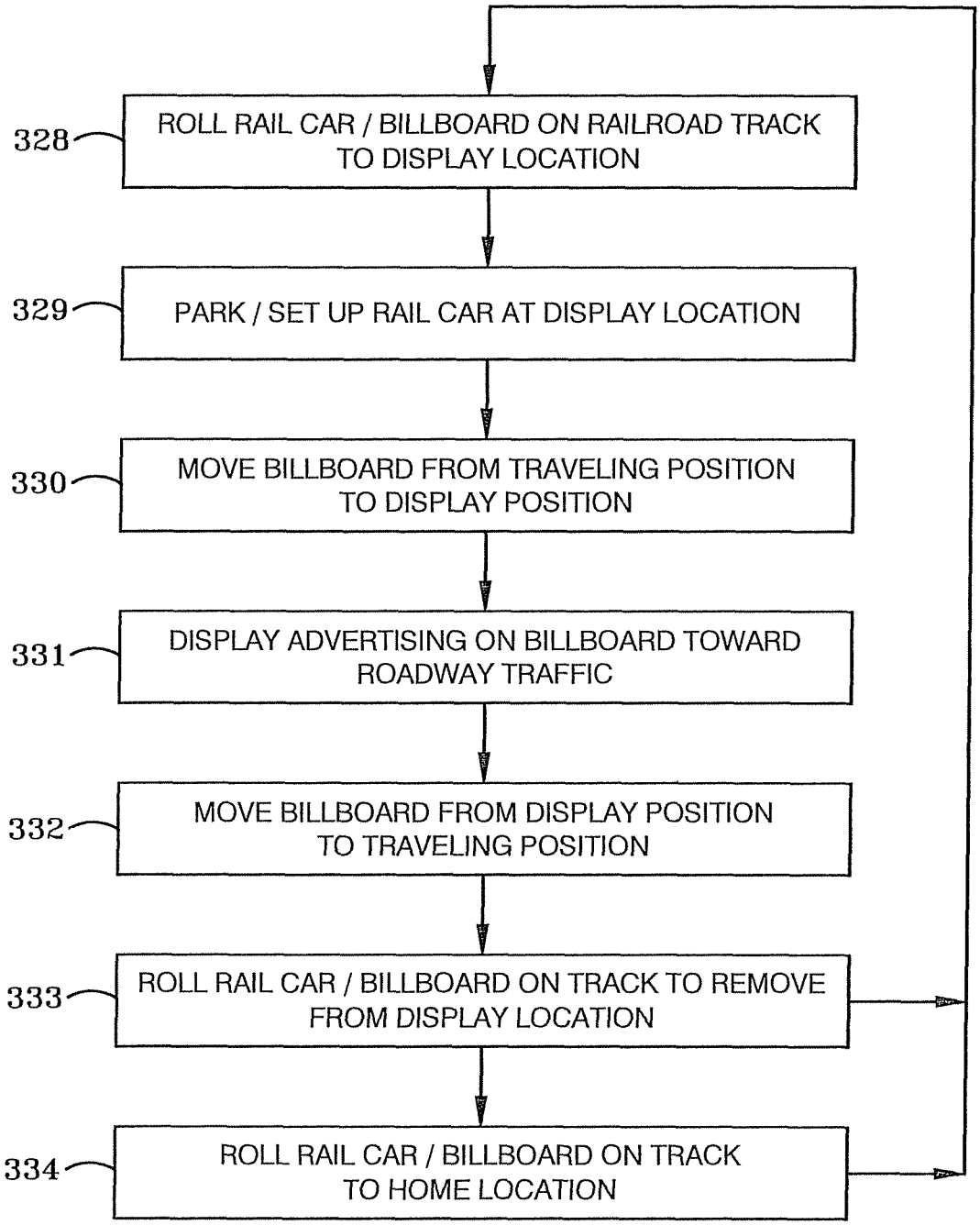
FIG. 6 is a flow chart showing the general method of advertising of the present invention.
Figure 7:
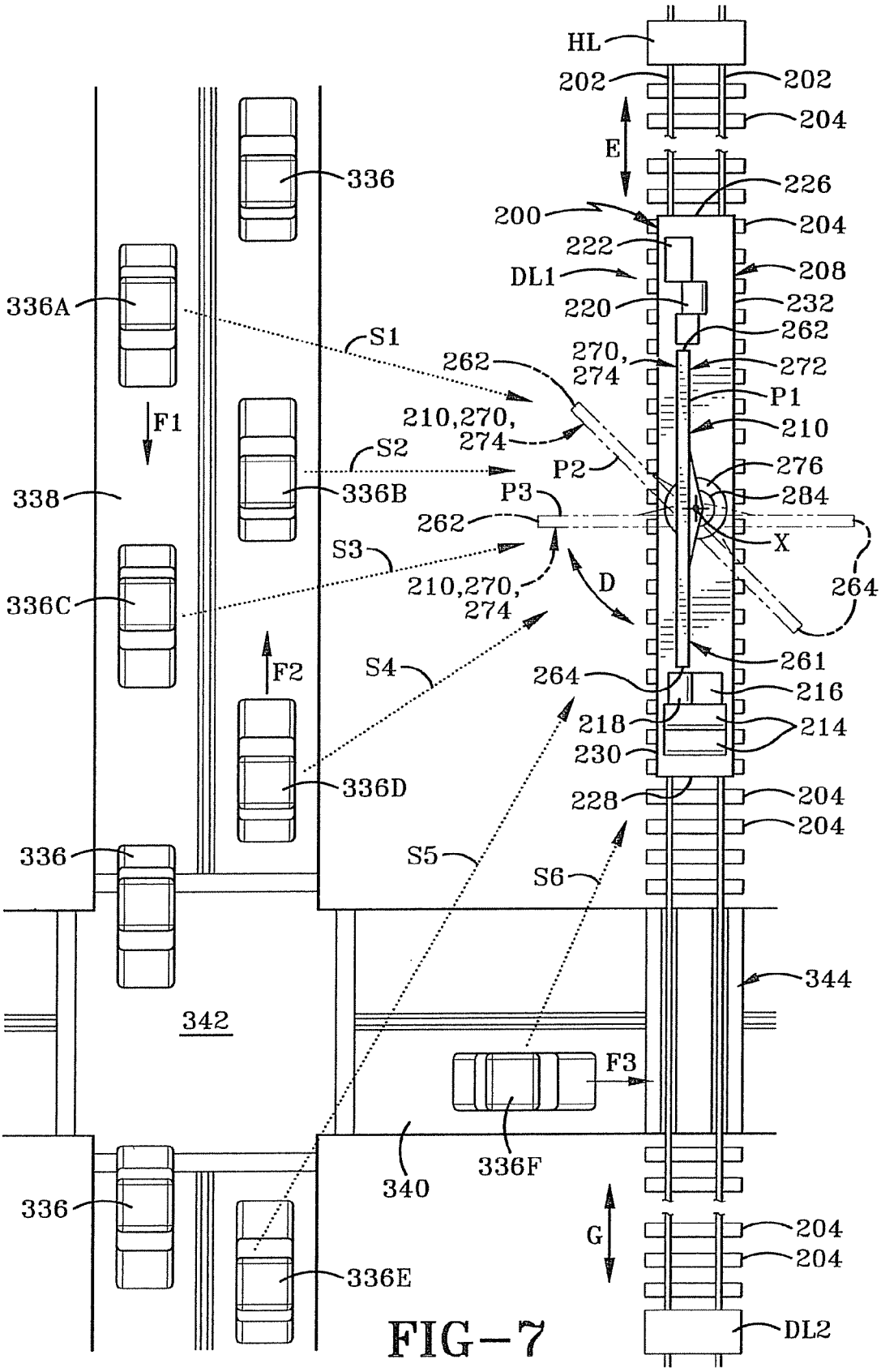
FIG. 7 is a diagrammatic top plan view showing the railcar parked at a display location adjacent roadways with one position of the billboard illustrated in solid lines and two additional positions of the billboard illustrated in dot-dash lines and various lines of sight illustrated by dotted line arrows corresponding to the different positions from which people within cars or trucks on the roadway may view the advertising on the billboard.

The operation and method of advertising in the present invention are now described with primary reference to FIGS. 6 and 7. FIG. 6 shows the general overall method in blocks 328-334, which will be explained in greater detail. Once system 200 is ready to be deployed, the railcar and billboard are rolled (Arrow E) along the railroad track from a home location HL (FIG. 7) to a display location such as display location DL1 (FIG. 7), as generally noted at block 328. The display location is typically relatively remote from the home location although this will vary under the given circumstances. However, the display location or locations may easily be several miles or hundreds of miles from the home location depending on the specific scenario. As previously noted, the railcar typically is not self-powered in order to drive itself along the railroad track and is thus pushed or pulled by a powered railcar from the home location to the display location and otherwise. Thus, the powered railcar may decouple from railcar 234 at the display location and ultimately be used to transport the personnel setting up system 200 at the display location back to the home location or elsewhere. During travel of system 200 from home location HL to display location DL1, the billboard and lift are in the travel position or transport position shown in FIG. 3, which shows that the lift including the telescoping pole and the billboard are in the lowered position and the billboard is substantially parallel to sides 230 and 232 of the railcar as well as parallel to rails 202. This position thus minimizes wind resistance during travel as well as keeps the billboard within the height limitation H2 (FIG. 1). In addition, if needed, protective cover 211 will be installed at the home location and remain in the covered or covering position of FIG. 3 during transport to the display location.

Once system 200 has arrived at the display location DL1, the railcar is parked and set up, as indicated at block 329 in FIG. 6. Part of this set-up may involve the deployment of outriggers 252 for windy conditions or if it is otherwise deemed desirable to increase the stability of the railcar. More particularly, outriggers 252 are moved from the raised position of FIG. 3 used during transport of system 200 to the lowered position shown in FIGS. 1 and 2, whereby outriggers move from a position out of contact with the rail bed into a position in contact with the rail bed to enhance the stability of the railcar. If fence 224 is not set up earlier, it may be deployed at the display location so that posts 256 are secured by locking mechanisms 260 in order to set up the perimeter of the fence along the outer perimeter of the railcar as discussed earlier. If electric power is available adjacent display location DL1, the plug-in option discussed earlier may be utilized to access electric power for operating the various electrical components of system 200. Otherwise, the onboard electrical generation system may be used, such as by beginning operation of motor 216 to power electric generator 218. Drive mechanism 220 is also started at this point in order to move the billboard from the traveling position to the display position, as noted at block 330. Drive mechanism 220 thus drives the lifting capability of the lift so that pole 212 telescopes upwardly in order to extend the pole sections 280 and 282 along with billboard 210 from the lowered position of FIG. 3 to the raised position of FIG. 1. It is noted, however, that where the billboard is at a sufficient height for advertising without being raised, this step of the process may be eliminated. When billboard 210A (FIGS. 4 and 5) is used instead of billboard 210, the step of moving the billboard from the traveling position to the display position additionally includes flipping section 292 upwardly about axis Y relative to section 290 from the closed or collapsed position of FIG. 4 to the expanded or raised position of FIG. 5, and also includes the step of securing section 292 in the raised position.

Drive mechanism 220 also drives the rotation of billboard 210 about axis X as desired in order to position the billboard at the desired angle. For instance, FIG. 7 illustrates that billboard 210 may be rotated about axis X from a position P1 (solid lines) in which billboard 210 is parallel to sides 230 and 232 and rails 202 to a position P2 or P3 illustrated in dot-dash lines. Billboard 210 in position P2 is rotated about 45° from position P1, and in position P3 is rotated about 90° from position P1. In position P1, billboard 210 (including its sides 270 and 272 and display section 274) are parallel to rails 202 and sides 230 and 232 as viewed from above. In position P2, billboard 210 is at an angle of about 45° relative to rails 202 and sides 230 and 232 as viewed from above. In position P3, billboard 210 is at an angle of about 90° relative to rails 202 and sides 230 and 232. Depending on the specific circumstances, billboard 210 may not need to be rotated from position P1 (nor raised) and thus may remain in position P1, which may be in the raised or lowered positions. Thus, the billboard 210 is positioned as desired in order to display advertising thereon toward roadway traffic, as noted at block 331. Thus, the position of billboard 10 is selected in accordance with the location of system 200 relative to motor vehicles 336 such as cars or trucks traveling along roadways such roadways 338 and 340. The position of billboard 210 may also depend on the direction of travel of the motor vehicle traffic. FIG. 7 illustrates that the railroad track is generally parallel to roadway 338 and generally perpendicular to roadway 340. Roadways 338 and 340 are shown meeting at a crossroads or intersection 342 while the railroad track is shown intersecting roadway 340 at intersection 344, which may be an actual intersection of the track with the roadway, or an overpass or underpass. FIG. 7 thus illustrates various possibilities of a display location at which system 200 might be used. As FIG. 7 shows, ends or edges 262 and 264 of billboard 210 are directly over railcar 208 in position P1 while they are not directly over the railcar in positions P2 and P3. Thus, edges 262 and 264 are directly over top surface 246 of deck 244 between sides 230 and 232 in position P1 and not directly over surface 246 between sides 230 and 232 in positions P2 and P3, but rather extend well beyond sides 230 and 232 respectively.

FIG. 7 illustrates in particular various lines of sight S1-S6 of the people respectively in several of motor vehicles 336 to billboard 210 and in particular, the respective lines of sight from a given person in a vehicle to the display side 270 and display section 274 of billboard 210. FIG. 7 illustrates to a flow of traffic on roadway 338 at arrows F1 and F2 and also the flow of traffic F3 in one of the lanes of roadway 340. For two-way traffic such as illustrated on roadway 338, it may be desired that billboard 210 be in position P1 such that, for instance, people in vehicles 336A-336D are able to see the advertising on display section 274 regardless of which direction they are traveling on roadway 338, as illustrated by lines of sight S1-S4. On the other hand, it may be advantageous to rotate billboard 210 to position P2 in order to enhance the ability of people in vehicles 336D-336F to better see the advertising on display section 274, as illustrated at lines of sight S4-S6. Billboard 210 in position P3 may be best suited for people in vehicles 336D and 336E (lines of sight S4-S5) such that the display section 274 is substantially perpendicular to the roadway and flow of traffic F2. FIG. 7 thus illustrates that billboard 210 may be positioned parallel, perpendicular, or at another angle such as 45° relative to a nearby roadway and the flow of traffic thereon in order to take best advantage of the specific circumstances. As previously noted, intersection 344 could be an overpass or underpass. In the case that intersection 344 is an overpass, it could also serve as a display location for system 200 so that the billboard 210 could be positioned directly above roadway 340.

During the display of the advertising on billboard 210 at display location DL1, the use of lights 254 may be desired, such as during the nighttime in order to illuminate the advertising section 274. If lights 254 are mounted on the frame of billboard 210 above or otherwise as illustrated at FIG. 1, such lights may be used to illuminate display section 274 regardless of whether billboard 210 is in position P1, P2, or P3. However, the lights 254 which are mounted on flatbed 234 may also be used to illuminate display section 274. More particularly, it may be that only some of lights 254 on flatbed 234 are powered to illuminate display section 274 when it is in a given position P1 or position P3 for example. As discussed earlier, control unit 222 may include a timer to control when lights 254 are illuminated or may include a light sensor which turns lights 254 on when it is sufficiently dark outside in accordance with the setting of the light sensor. Control unit 222 may also include various other types of controls for controlling when lights 254 are turned off and on.

As discussed in the Background section of the present application, some railroad tracks are no longer in use and others are used relatively sparingly. In the former case, system 200 could theoretically remain in a display location indefinitely although more likely system 200 would at some point be moved for servicing purposes or to be relocated to another display location. Furthermore, where a railroad track which is being used relatively rarely, system 200 may be set up for a specific duration of time to be used for advertising, but may then be removed in order to allow trains to travel along the railroad track through the display location, after which the system 200 may be returned to the same display location if desired. Regardless of the reason that system 200 would be moved from the display location DL1, the next step would be to move the billboard from a display position to the traveling position, as shown in block 332. When billboard 210A is used instead of billboard 210, the step of moving the billboard from the display position to the traveling position also involves releasing the securing mechanism which secures section 292 in a raised position so that section 292 may be moved from the raised position of FIG. 5 to the lowered or collapsed position of FIG. 4. Thus, if billboard 210 has been raised and/or rotated to a display position while at the display location, it may be lowered and rotated back to the travel position of FIG. 3 in order to prepare for travel of system 200, and more particularly the rolling of railcar and billboard on the railroad track to remove system 200 from the display location, as noted at block 333. Depending on the circumstances, removing system 200 from display location DL1 may involve returning to the home location HL (Arrow E) by rolling the railcar and billboard along the track, as indicated at block 334. Alternately, system 200 may be rolled along the track from display location DL1 to a second display location DL2, as shown at Arrow G in FIG. 7. If system 200 does go to another display location, the process begins again so that the railcar is parked on the track and the billboard is moved to the display location for advertising at the subsequent display location. Of course, the system may return to the home location HL and subsequently be deployed to another display location for additional advertising purposes. Furthermore, the home location HL or display location DL2 shown in FIG. 7 may represent a temporary parking place for system 200 at which the railcar may be parked temporarily off of the primary railroad track shown in order to allow a train to pass along this railroad track and subsequently allow system 200 to move back to the display location DL1 for another duration of advertising. Thus, system 200 may be used for several days at a given display location and may subsequently move to another location and return to the same display location to continue advertising there for another several days, for example. On the other hand, system 200 may be used at a display location and then returned to the home location for servicing or other purposes. System 200 may also be moved from the first display location to another display location either directly or indirectly after a return to the home location.

Figure 8:
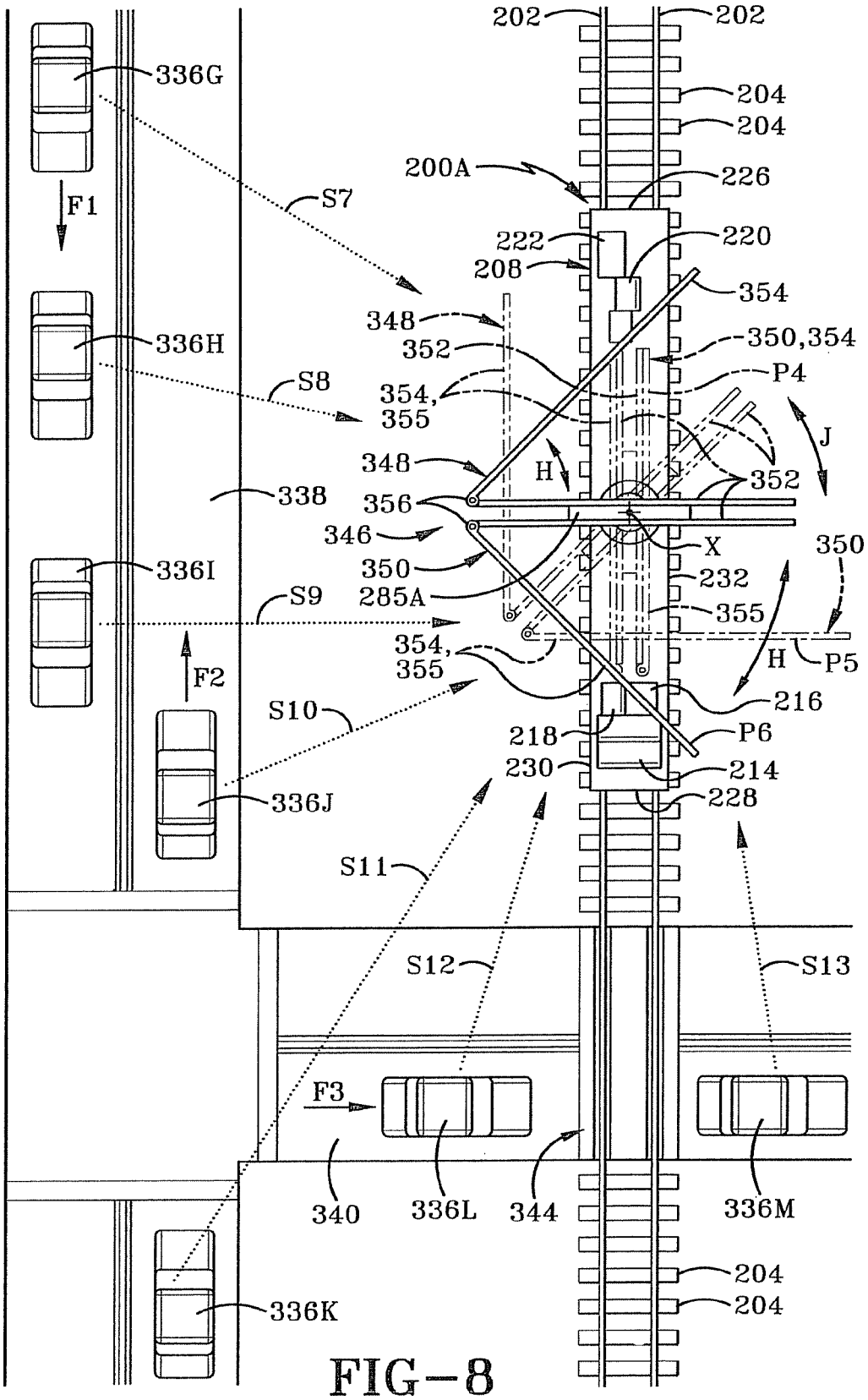
FIG. 8 is similar to FIG. 6 and shows the use of an alternate billboard configuration.

FIG. 8 illustrates an alternate portable advertising system 200A which is similar to system 200 except that it uses a billboard assembly 346 which includes first and second billboards 348 and 350 which are substantially mirror images of one another. Each of billboards 348 and 350 includes a rigid rectangular primary frame 352 which is generally similar in structure to the frame of billboard 210. Primary frames 352 are rigidly secured to mounting flanges 285A (similar to flanges 285 in FIG. 2), which in turn are rigidly secured to the top segment 280 of the telescoping pole. Each of billboards 348 and 350 also includes a rigid rectangular secondary frame 354 which is substantially the same size as the primary frame 352. Each secondary frame 354 is pivotally connected to the respective primary frame 352 about a vertical pivot axis of a pivot 356 which is respectively adjacent a vertical edge of the primary frame and vertical edge of the secondary frame opposite the opposed ends of the respective frames 352 and 354. Arrows H illustrate the pivotal movement of each secondary frame 354 relative to the respective primary frame 352 between an open position shown in solid lines and a closed position (P4) which is shown in dot-dash lines in which the primary and secondary frames 352 and 354 are also in the traveling position parallel to the sides 230 and 232 and rails 202.

The entire billboard assembly 346 and post 212 is rotatable (Arrow J) about axis X, just as is true of the billboard 210 and post 212 of system 200. More particularly, FIG. 8 illustrates billboard assembly 346 in a first position P4 in dot-dash lines which illustrates the travel position, a second position P5 (dot-dash lines) in which the secondary frames 354 are open 45° relative to the primary frames 352 and the entire billboard assembly 346 is rotated 45° relative to position P4, and a position P6 (solid lines) in which the secondary frames 354 are in the open position and the entire billboard assembly 346 is rotated 90° relative to position P4 and 45° relative to position P5. As with billboard 210 of system 200, the opposed ends of billboards 348 and 350, including the opposed ends of frames 352 and 354 are directly above the railcar in the travel position P4, but are not directly above the railcar in the display positions P5 and P6, but are rather positioned outwardly beyond sides 230 and 232 respectively. Each secondary frame 354 has a display side upon which is mounted an advertising display section 355 analogous to advertising section 274 of system 200. Display sections 355 in position P4 are parallel to and face away from one another. Display sections 355 in the open position of secondary frames 354 are at about a 90° angle relative to one another. In position P5, frames 352 are at an angle of about 45° relative to rails 202 and sides 230 and 232 as viewed from above. In position P5, frame 354 of billboard 348 is parallel to rails 202 and sides 230 and 232 while frame 354 of billboard 350 is perpendicular to rails 202 and sides 230 and 232. In position P6, frames 352 are perpendicular to rails 202 and sides 230 and 232 while frames 354 are respectively at an angle of about 45° relative to rails 202 and sides 230 and 232 as viewed from above.

Similar to FIG. 7, FIG. 8 illustrates several motor vehicles 336G-336M and the respective lines of sight S7-S13 of the people in these vehicles towards the display sections of billboards 348 and 350. Billboard assembly 346 is particularly configured to take advantage of advertising to vehicles coming from different directions when in the open position of the secondary frames. For instance, when assembly 346 is in position P6, people in vehicles 336G and 336H traveling in the traffic flow direction F1 can best see the advertising on display section 355 of billboard 348, as illustrated at lines of sight S7 and S8. In position P6, people in vehicles 336J and 336K traveling in the direction of traffic flow F2 and people in vehicle 336L traveling in the direction of traffic flow F3 are best able to see the display section 355 of billboard 350. Display sections 355 in position P6 are thus at an angle of about 45° relative to either of roadways 338 and 340, as well as relative to rails 202 and sides 230 and 232 of the railcar. In position P5, the display section 355 of billboard 348 is parallel to roadway 338 and its flow of traffic and perpendicular to roadway 340 and its flow of traffic while the display section 355 of billboard 350 is parallel to roadway 340 and its flow of traffic and perpendicular to roadway 338 and its flow of traffic. In position P5, display section 355 of billboard 348 is also parallel to rails 202 while display section 355 of billboard 350 is perpendicular to rails 202.

Even though position P4 is the traveling or transport position of billboard assembly 346, advertising display section 355 of billboard 348 is parallel to and faces roadway 338 and may still be useful as an advertising display in this position, whether the railcar is parked or traveling along the railroad track. The display section 355 of billboard 350 in position P4 may also be used for advertising depending on its location relative to the respective roadways and vehicles thereon.

The portable advertising systems of the present invention thus allow a railcar to be parked at any given location on a railroad track with a billboard thereon in order to display advertising to people in motor vehicles driving along roadways adjacent the railroad track. System 200 conveniently allows the billboard sign to be raised to a suitable height and to be rotated at a desired angle in order to take advantage of the specific circumstances including the angle at which the roadway runs relative to the railroad track as well as the flow of traffic along the roadway. System 200 also provides the ability to use a large advertising billboard at a display location along the railroad track such that the billboard exceeds the height limitations for railway vehicles during transport.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An advertising system for use on a railroad track, the system comprising:

a railcar having a deck area and track-engaging wheels adapted to roll on the railroad track;

an advertising billboard mounted on the railcar above the deck area;

a security fence which extends around the deck area to deter trespassers; and at least one locking mechanism securing the fence to the railcar so that the fence cannot be removed from the railcar without the use of a key configured to unlock the at least one locking mechanism.

2. The system of claim 1 wherein the fence comprises barbed wire, concertina wire or razor wire.

3. The system of claim 1 further comprising a support post within the fence; wherein the billboard is mounted on the railcar by the support post.

4. The system of claim 1 further comprising a lift within the fence which is operatively connected to the billboard for raising and lowering the billboard.

5. The system of claim 1 further comprising a drive mechanism within the fence which is operatively connected to the billboard to drive movement of the billboard.

6. The system of claim 1 further comprising a fuel tank within the fence.

7. The system of claim 1 further comprising a fuel powered engine within the fence.

8. The system of claim 1 further comprising an electric generator within the fence.

9. The system of claim 1 further comprising solar panels within the fence.

10. The system of claim 1 further comprising a hydraulic pump assembly within the fence.

11. The system of claim 1 further comprising a lighting assembly within the fence.

12. The system of claim 11 further comprising a control unit within the fence which is in communication with the lighting assembly and configured to control when the lighting assembly is turned on and off.

13. The system of claim 1 further comprising a lighting assembly positioned so that when illuminated, light emitted therefrom shines onto the billboard; and a control unit within the fence which is in communication with the lighting assembly and configured to control when the lighting assembly is turned on and off.

14. The system of claim 13 wherein the control unit comprises a timer and a light sensor for sensing the ambient light.

15. The system of claim 1 further comprising a plurality of outriggers carried by the railcar and respectively movable between a raised travel position adapted allow the railcar to travel along the railroad track and a lowered stabilizing position adapted to stabilize the railcar when parked; and a drive mechanism within the fence which is operatively connected to the outriggers to drive movement of the outriggers between their respective raised and lowered positions.

16. An advertising system for use on a railroad track, the system comprising:

a railcar having a deck area and track-engaging wheels adapted to roll on the railroad track;

an advertising billboard mounted on the railcar above the deck area;

a security fence which extends around the deck area to deter trespassers and comprises a plurality of fence posts removably mounted on the railcar; and a plurality of locking mechanisms which respectively secure the posts to the railcar so that the fence posts cannot be removed from the railcar without the use of a key configured to unlock the respective locking mechanism.

17. The system of claim 16 wherein the fence comprises barbed wire, concertina wire or razor wire.

18. The system of claim 16 wherein the fence comprises wire strung between the fence posts.

19. A method comprising the steps of:

displaying advertising on a billboard above a deck area of a railcar on a railroad track;

deterring trespassers from gaining access to the deck area with a security fence which extends around the deck area; and unlocking at least one locking mechanism with a key to allow at least a portion of the fence to be detached from the railcar.

20. The method of claim 19 wherein the step of unlocking comprises unlocking a plurality of locking mechanisms which respectively secure fence posts to the railcar to allow a plurality of the fence posts to be detached from the railcar.

* * * * *